US005129460A

United States Patent [19]

Ritter, Jr.

[11] Patent Number: 5,129,460

[45] Date of Patent: Jul. 14, 1992

[54] GUIDE BASE COVER

[75] Inventor: Paul B. Ritter, Jr., Slidell, La.

[73] Assignee: Shell Offshore Inc., Houston, Tex.

[21] Appl. No.: 693,871

[22] Filed: Apr. 30, 1991

[51] Int. Cl.[5] ..... E21B 41/04; E21B 33/037

[52] U.S. Cl. ..... 166/368

[58] Field of Search ..... 166/368, 356, 363, 351, 166/97, 75.1; 405/211, 212

[56] References Cited

U.S. PATENT DOCUMENTS 4,220,421 9/1980 Thorne ..... 166/368 X 4,273,472 6/1981 Piazza et al. ..... 166/356 X 4,387,771 6/1983 Jones ..... 166/368 X 4,427,072 1/1984 Lawson ..... 166/368 X 5,012,854 5/1991 Bond ..... 166/97 X

*Primary Examiner*—Stephen J. Novosad

[57] ABSTRACT

A protective cover for protecting a wellhead mandrel and related equipment of a subsea wellhead when the drilling and producing equipment is removed. The protective cover is installed and removed using a pipe or cable running string with provisions for using either a hydraulic jet, a Remotely Operated Vehicle (ROV) or surface rig movements to position the cover.

8 Claims, 3 Drawing Sheets

GUIDE BASE COVER

BACKGROUND OF THE INVENTION

The present invention relates to equipment utilized in drilling offshore oil and gas wells, and particularly to equipment that is useful in drilling offshore oil and gas wells using a tension leg platform.

In the drilling of offshore wells, it has been the practice to use either fixed platforms or drilling rigs which are fixed in location. The drilling rigs normally are jackup rigs in which long piles are lowered into contact with the ocean floor and jack the drilling platform above the water to provide a fixed platform for drilling operations. As operations moved into deeper waters, it became the practice to use a floating platform which was referred to as a semic-submersible platform that was anchored in place by conventional anchor cables and anchors. In both of these operations, once the wells were drilled and completed, the drilling rig was moved off and replaced by a fixed platform that was supported by means of long columns extending upward from the ocean floor. At times the fixed platform also included drilling equipment so that additional wells could be drilled after the fixed platform was in position.

The use of fixed platforms is limited to roughly 1000 to 1500 feet of water. In deeper waters the cost of the platform and the difficulty in setting the platform becomes prohibitive. In order to solve this problem a platform referred to as a tension leg platform has been developed for use in these extremely depp waters. A tension leg platform refers to a platform in which tension legs are used to draw the platform down below its normal floating level and maintain it in a relatively stable position regardless of wind or wave action.

While the use of a tension leg platform provides a stable drilling platform for use in deep waters, the equipment used in drilling in shallow water cannot alwasy be used in deeper waters. One problem that arises is that the wells must be drilled and cased but cannot be completed due to the lack of space on the platform during drilling operations. Thus, the wellheads must be left on the ocean floor to be subsequently completed after drilling operations have ceased. The temporary abandonment of the wellhead on the seafloor subjects the wellhead to the corrosive action of the seawater as well as the possibility of debris, marine growth and other foreign matter damaging the wellhead or entering the open well casing. Therefore, steps must be taken to protect the temporarily abandoned wellhead until such time as the well is completed and connected to the surface by suitable production tubing.

SUMMARY OF THE INVENTION

The present invention solves the aforementioned problems by providing a protective cover that can be installed on the wellhead after the completion of the drilling operations using the drill string or cable means as the installation means. Back-up provisions are made for using a remotely operated vehicle (ROV) to assist in the placing of the protective cover.

The protective cover utilizes the permanent guide base which is installed around the wellhead to guide it into position on top of the wellhead. The protective cover seals the wellhead from the outside environment and prevents debris from falling into the open well. The protective cover also includes means for displacing the seawater from the top portion of the well with a protective fluid. The protective fluid is chosen so that it has a lower density than seawater and after it displaces the seawater it will remain on top of the seawater and drilling mud remaining in the well. This will protect the machined and finished surfaces on the wellhead that will be required for installing the producing equipment on top of the wellhead when the well is subsequently completed.

The protective cover is also designed to allow the passage of small debris past the wellhead while deflecting larger debris from the wellhead.

The protective cover can be removed utilizing the same drill string or cable and ROV that were used to run the protective cover and install it to the wellhead. After the cover is removed it can be moved to another location on the ocean floor or it can be retrieved to the surface. Provisions are also provided for replenishing the protective fluid without returning the cover to the surface.

BRIEF DESCRIPTION OF THE DRAWINGS

The present invention will be more easily understood from the following description when taken in conjunction with the attached drawings in which.

DESCRIPTION OF THE PREFERRED EMBODIMENT

Figure 1:
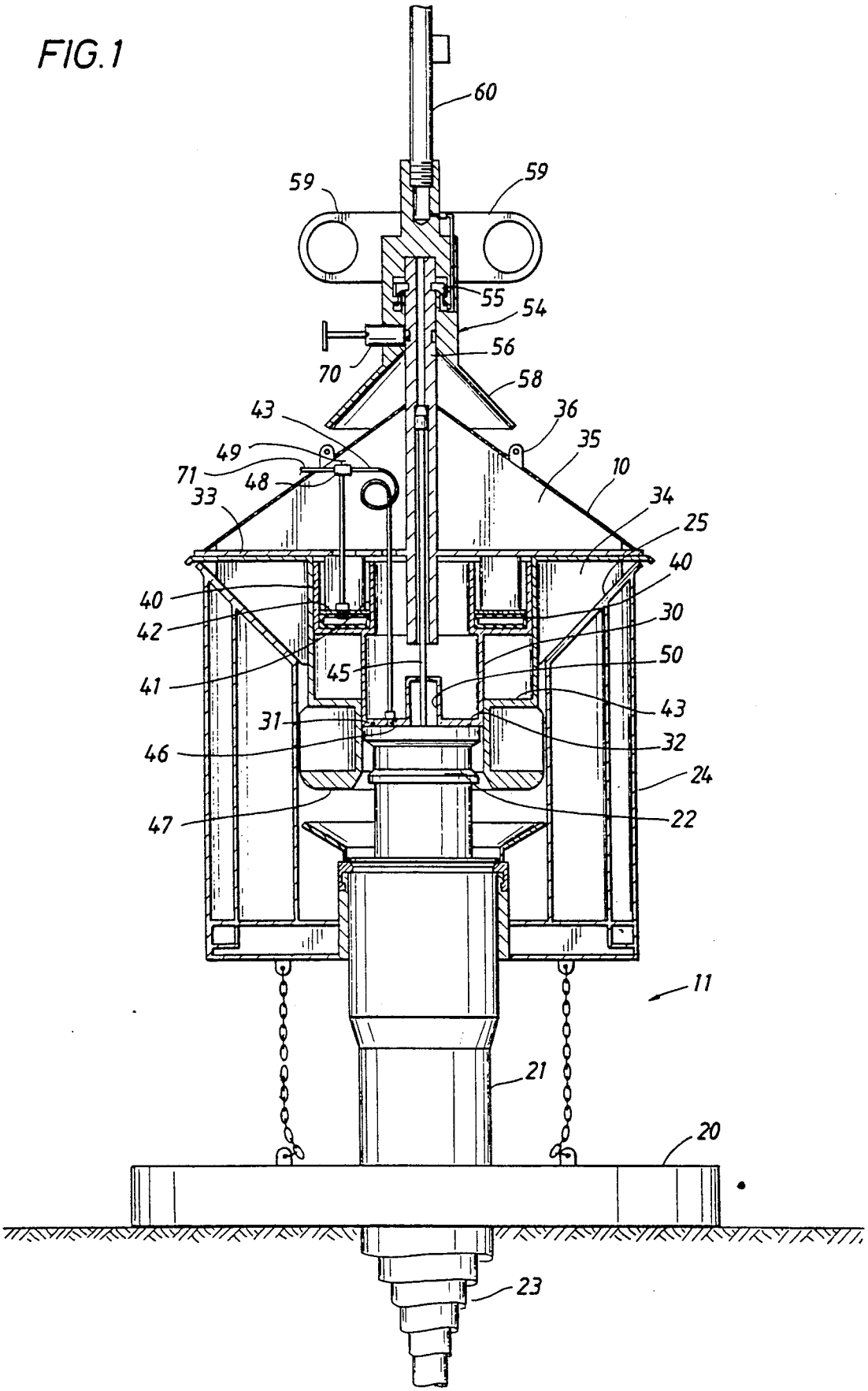
FIG. 1 is an elevation view of the cover partially in section.
Figure 2:
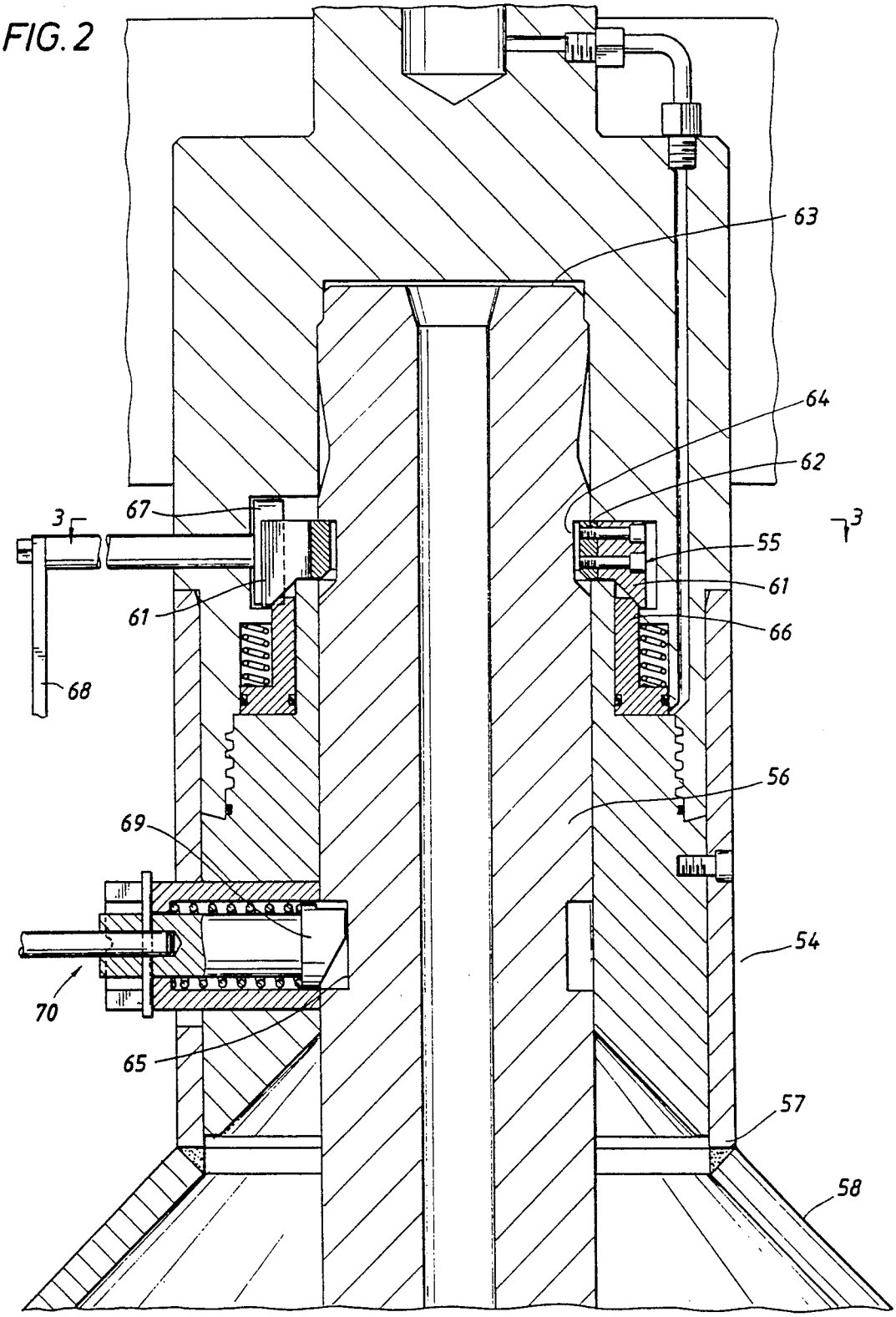
FIG. 2 is an elevation view of the running tool used for installing the cover.

Referring to the drawings, there is shown a protective cover 10 installed on the subsea wellhead 11. The protective cover is installed on the well by running it on a drill string 60 or cable and then releasing the running string or cable from the protective cover. The wellhead includes a base or mud mat 20 which is positioned on the ocean floor to support the outer casing strings during cementing and to properly space the wellhead assembly above the mud line. In particular, the surface casing 21 is attached to the mud mat and extends upward to support the wellhead assembly including that required for producing the well. In addition to the surface casing 21, additional casing strings 23 are shown positioned inside of the surface casing. The upper end 22 of the casing is provided with suitable machined and finished surfaces for attaching both the equipment used during drilling of the well, for example, blowout preventers and other wellhead equipment, as wellas the producing equipment utilized for producing the well, for example, a Christmas tree production riser or other equipment, as well as the producing equipment utilized for producing the well, for example, a Christmas tree production riser or other equipment.

The well is provided with apermanent guide base 24 that is attached to the surface casing. The guide base includes an upwardly positioned vertical guide funnel 25 the top that serves to guide equipment lowered from the surface onto the end of the surface casing 22 that extends up through the guide funnel 25. The use of four individual cut-outs that are positoned equally around the funnel structure provides suitable openings in the fuhnnel through which debris may pass. In addition the cut outs provide access for a remotely operated vehicle (ROV) to visually inspect the wellhead or conduit mechanical operations.

The top end and outer diameter of the wellhead is covered by a cylindrical member 30 which surrounds the wellhead as shown in FIG. 1. A sealing means 31 (for example an "O" ring) is positioned on the bottom surface 32 of the cylindrical member an seals on the top surface of the wellhead. suitable guide plates or gussets 34 are positioned around the circumference of the cylindrical member. The plates 34 serve both to reinforce the cylindrical member and act as a guide means for guiding the member into the guide base and onto the wellhead.

The top of the protective cover is provided with a plurality of gussets 35 that may be covered with screen-like material if desired. The top of the protective cover also serves to deflect from the wellhead any debris flowing in the ocean currents and therefore prevent damage to the wellhead. Lifting eyes 36 are positioned around the gussets 35 and provide a means for handling the protective cover at the surface. The lifting eyes 36 also provides a location to which an ROV may attach itself to perform various operations on the protective cover.

Positioned inside of the cover 10 is a donut-shaped bladder 40. The bladder 40 contains a protective fluid which can be used to displace the salt water or drilling lufid from the top of the wellhead and the protective cover to protect the wellhead from the corrosive action of seawater and other fluids. In addition, as explained above, the fluid should lighter than seawater so that it will float on the seawater and drilling mud that remains in the well. An example suitable fluid would be a petroleum lubricating oil. The bladder is constrained by the cylindrical side walls 40 and 41 and a piston 42. The piston is attached to the base plate 33 of the cover while the container 40 is collapsed by upward movement of the lower part of the cover. The lower part of the cover is prevented from moving downward by the horizontal plate 33.

The fluid contained in the bladder is pressurized by means of the weight of the cover as it is lowered onto the wellhead. The fluid in the bladder is transported by a pipe 43 on the top of the interior of the wellhead. The flow of fluid from the bladder is controlled by the valve 48 that is opened by rotating the stem 49. The stem can be rotated by a remote operating vehicle that is equipped with conventional valve operating means. Additional fluid can be supplied to the system through the line 71 through suitable valve means (not shown). A stinger 45 is retained in the cover with its lower end 46 being substantially aligned with the bottom 47 of the cover. The stinger serves to vent the salt water and/or drilling fluid from the interior of the wellhead as it is displaced by the protective fluid flowing through the pipe 43 into the top of the wellhead. The stinger 45 is retained in the cylindrical member 30 by a "C" shaped ring (not shown) that fits in an annular groove formed in the cylindrical surface 50 of the member 30. The combination of the bladder 40 supply pipe 43 and stinger 45 provides a reliable means for displacing the fluid from the top of the surface casing tht requires no outside assitance for its operation.

The protective cover is installed on the well by means of a running tool 54 which is secured to the end of the running string 60. The running tool 54 is provided with suitable latch means 55 for latching to tool post 56 that extends upwardly from the top of the protective cover. The lower end 57 of the running tool is provided with a tapered or conical surface 58 to assist it in positioning the running tool on the tool post. The upper end of the running tool is provided with two ears 59 that contain suitable openings for attaching an ROV tugline to the running tool. This may be necessary at times to guide the running tool onto the tool post when the protective cover is being installed or removed. Normally, positioning of the running tool on the tool post will be accomplished by ROV observation and movements of the surface platform. Optionally a series of jets (not shown) may be positioned around the circumference of the running tool for moving the cover laterally to position it over the wellhead. A second locking means 70 is provided for securing the running tool to the tool post 56. The running tool may be provided with a flexible joint, if desired, so that the drill string can move without placing undue stres on the protective cover.

Figure 3:
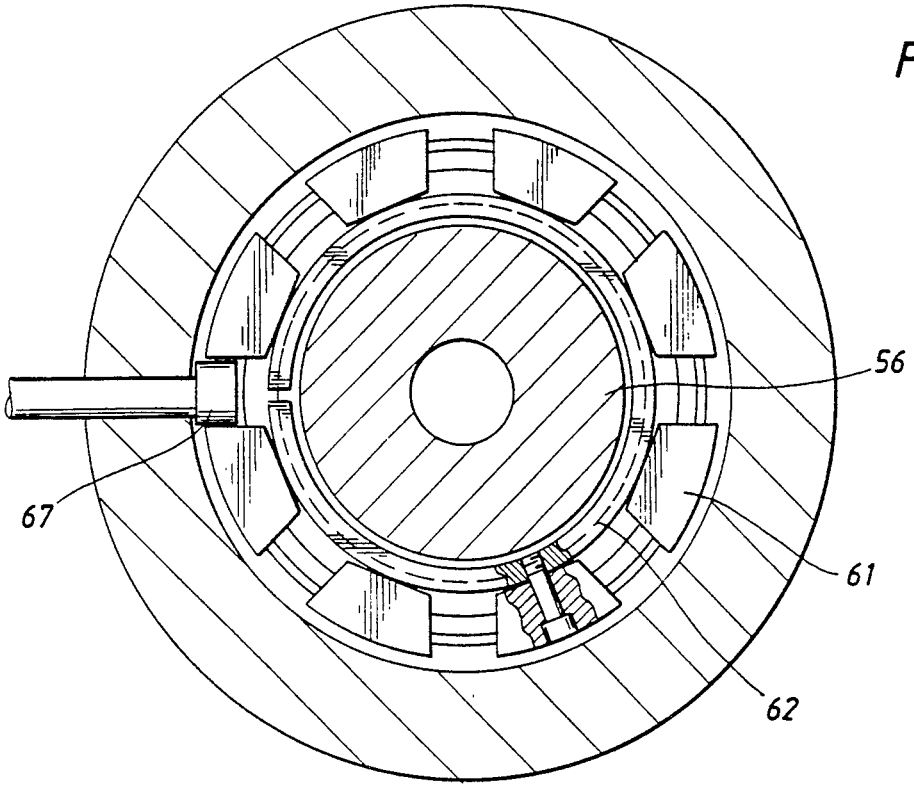
FIGS. 3 and 4 are details of the means for releasing the running tool from the cover.
Figure 4:
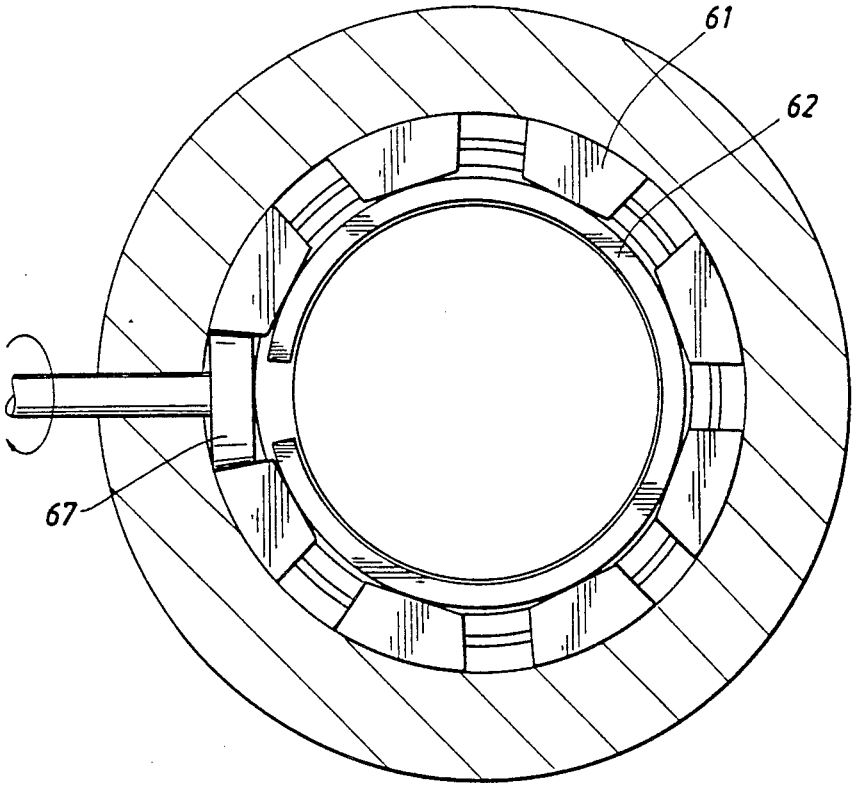

The locking means 55 is secured to the tool post 56 by lowering the running tool onto the tool post. The individual cams 61 are attached to the "C" ring 62 and when the cams contact the top 63 of the tool post they open the "C" ring and allow it to slide over the tool post and engage the groove 64. The lock means 70 is a spring loaded lock that will slide over the tool post and engage the groove 65. The locking means 55 is disengaged by supplying fluid pressure through the drill string 60 to move the piston 66 and force the "C" ring 62 open as shown in FIG. 4. If the piston means 66 fails to operate the cam means 67 can be operated by an ROV rotating the arm 68 to open the "C" ring 62 as shown in FIGS. 3 and 4. The locking means 70 is also operated by an ROV pulling the dog 69 out of engagement with the groove 65.

From the above description it is seen that the running tool can be secured to the tool post on the cover by lowering onto the cover. Thus, the cover can be removed whenever it is necessary. After the cover is installed the running tool is removed by a combination of fluid pressure and manipulation by an ROV.

What is claimed is:

1. A protective cover for the wellhead of a subsea well, comprising:

a cylindrical member, said cylindrical member being closed at one end and opened at the other end;

a seal means, said seal means being disposed on the closed end of said cylindrical member and adapted to form a seal between said closed end of said cylindrical member and the surface of said wellhead when said protective cover is placed over said wellhead;

a support member, said cylindrical member being secured to said support member; and a tool post, said tool post being secured to said support member, and adapted to releasably engage a running tool secured to the end of a running string whereby said protective cover may be installed and removed from said wellhead.

2. The protective cover of claim 1 wherein said running tool includes a release means that is remotely operated.

3. The protective cover of claim 1 and, in addition, a closed container means mounted on said support member and means mounted on said support member for selectively transferring a fluid from said container means to the wellhead to displace fluid in said wellhead with said fluid in said container means.

4. The protective cover of claim 3 wherein the means for selectively transferring the fluid from the closed container means comprises means for pressurizing the closed container means and a valve means for controlling the flow of said first fluid from the closed container means to the wellhead.

5. The protective cover of claim 4 and in addition, a first pipe mounted on said support member and disposed to discharge said fluid into said wellhead and a second pipe mounted on support means and disposed to extend into said wellhead when said protective cover is installed on said wellhead to purge fluid from said wellhead when said first fulid is discharged into said wellhead.

6. The protective cover of claim 5 wherein said closed container means is formed by an annular ring shaped cylinder, said ring shaped cylinder being closed at one end, a ring shaped piston disposed in said ring shaped cylinder and operative to be moved by the weight of the protective cover to displace fluid from said cylinder.

7. The protective cover of claim 6 wherein said solid closed container is provided with valve means for replenishing the fluid in said closed container from an external source .

8. The protective cover of claim 6 wherein the fluid in the closed container means is pressurized by the weight of the protective cover moving the piston in the ring shaped cylinder, thereby pressurizing the fluid in the ring shaped cylinder.

* * * * *